United States Patent [19]

Dauphinais

[11] 3,981,050

[45] Sept. 21, 1976

[54] SHOULDER STRAP RETAINER

[76] Inventor: Henry F. Dauphinais, P.O. Box 235, Rte. 202, Bantam, Conn. 06750

[22] Filed: Apr. 7, 1975

[21] Appl. No.: 565,779

[52] U.S. Cl. ..... 24/76; 24/86 R; 24/85 R; 24/73 LF; 24/87 R

[51] Int. Cl.[2] ..... A44B 9/00; A44B 21/00

[58] Field of Search ..... 24/73 LF, 86 R, 86 B, 24/48, 46, 76, 85 R, 85 B, 259 A, 182, 73 SF; 2/2

[56] References Cited

UNITED STATES PATENTS

| | | | |
|---|---|---|---|
| 312,109 | 2/1885 | Fay | 24/46 |
| 374,931 | 12/1887 | Brooks | 24/73 LF |
| 775,013 | 11/1904 | McRae | 24/86 B |
| 851,327 | 4/1907 | Thompson | 24/86 B |
| 1,594,051 | 7/1926 | DeMos | 24/73 LF |
| 1,763,132 | 6/1930 | Chase | 24/73.1 |
| 2,005,570 | 6/1935 | Smith | 24/73 SF |
| 2,154,329 | 4/1939 | Guillod | 24/259 A |

FOREIGN PATENTS OR APPLICATIONS

| | | | |
|---|---|---|---|
| 494,030 | 2/1950 | Belgium | 24/86 R |
| 32,900 | 3/1905 | Switzerland | 24/85 R |

*Primary Examiner*—Bernard A. Gelak
*Attorney, Agent, or Firm*—John E. Toupal

[57] ABSTRACT

A shoulder strap retainer including a base plate, a holder strip portion supported on one side of the base plate and extending toward one end thereof and forming a chamber for receiving a shoulder strap, and a securing mechanism supported on the opposite side of the base plate and comprising a pair of spaced apart substantially parallel pins extending toward an opposite end of the base plate and adapted to penetrate clothing worn on a person's shoulder. The strip holder is formed by a cut-out central portion of the base plate and bent to provide a spacer portion extending away from the base plate and a terminal portion extending toward the one end thereof and spaced therefrom by a minimum of one-quarter inch.

3 Claims, 4 Drawing Figures

SHOULDER STRAP RETAINER

BACKGROUND OF THE INVENTION

This invention relates generally to a shoulder strap retainer and, more particularly, to a shoulder strap retainer for attachment to clothing worn on a person's shoulder.

Straps are employed to support many types of receptacles from the shoulder of a person carrying the receptacle. Examples of receptacles that utilize shoulder straps include handbags, camera cases, diaper bags, etc. Although such shoulder straps usefully free the user's hands for any desired activity, they are plagued by one particular problem. Since most persons possess slightly sloping rather than perfectly horizontal shoulders, the straps tend to slide downwardly on a shoulder. This tendency is accentuated by any movement of the person utilizing the strap. As a result of the sliding tendency, the receptacle is either dropped or the user must make tedious periodic readjustments of the strap on his shoulder.

The object of this invention, therefore, is to provide a retainer that can be easily secured to the clothing worn on a person's shoulder and will reliably prevent slippage thereon of a strap supporting a receptacle.

SUMMARY OF THE INVENTION

This invention is a shoulder strap retainer including a base plate, a holder strip portion supported on one side of the base plate and extending toward one end thereof and forming a chamber for receiving a shoulder strap, and a securing mechanism supported on the opposite side of the base plate and comprising a pair of spaced apart substantially parallel pins extending toward an opposite end of the base plate and adapted to penetrate clothing worn on a person's shoulder. The strip holder is preferably formed by a cut-out central portion of the base plate and bent to provide a spacer portion extnding away from the base plate and a terminal portion extending toward the one end thereof and spaced therefrom by a minimum of one-quarter inch. The pair of spaced apart securing pins extending oppositely to the strip holder prevents twisting of the retainer when inserted into material covering a person's shoulder while the oppositely directed holder and securing portions cause the supported receptacle's weight to exert a force tending to more securely fix the retainer in place.

In a preferred embodiment of the invention, the securing mechanism is formed from a continuous wire strip having pointed ended terminal portions that serve as pins and a transversely bent mid-section that is secured to the base plate. The wire is bent at the mid-section to provide spacer portions extending from the mid-section to the pin portions that are spaced apart and parallel to the base plate. Another feature of the invention entails the use of a recess in the base plate that simplifies locations of the mid-section thereto and establishes greater structural integrity for the joint therebetween.

DESCRIPTION OF THE DRAWINGS

These and other features and objects of the present invention will become more apparent upon a perusal of the following description taken in conjunction with the accompanying drawings wherein.

DESCRIPTION OF THE PREFERRED EMBODIMENT

Figure 1:
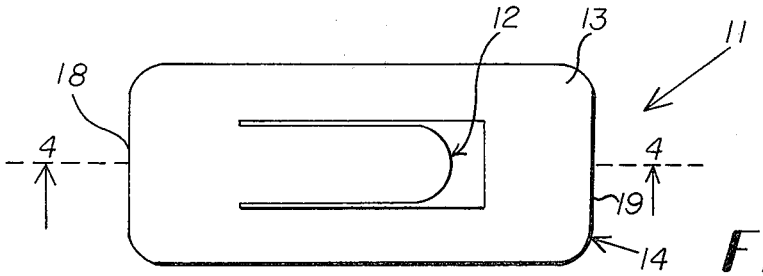
FIG. 1 is a top view of a shoulder strap retainer according to the invention.
Figure 2:
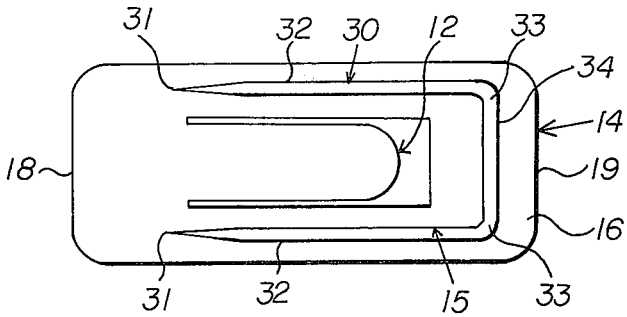
FIG. 2 is a bottom view of the retainer shown in FIG. 1.

Referring now to the Figs. there is shown a shoulder strap retainer 11 according to the present invention. The retainer 11 includes a holder portion 12 supported on one side 13 of a preferably metallic base plate 14 and a securing mechanism 15 mounted on an opposite side 16 thereof. The holder portion 12 is a rectangular strip having three edges formed by orthogonally related cuts through a central portion of the plate 14 and secured thereto along an uncut edge 17. The uncut edge 17 is adjacent to one end 18 of the plate 14 and the strip 12 extends toward an opposite end 19 thereof.

Figure 3:
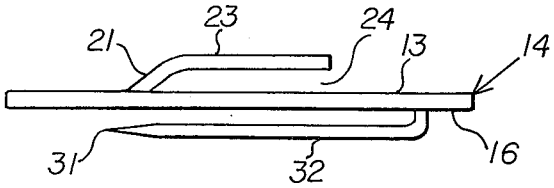
FIG. 3 is a side view of the retainer shown in FIGS. 1 and 2.
Figure 4:
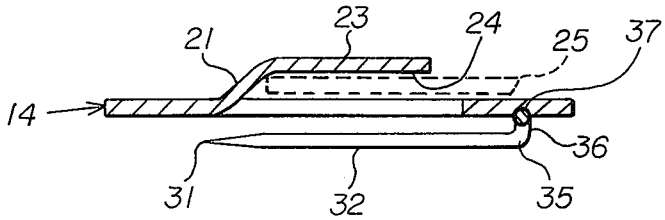
FIG. 4 is a cross-sectional view taken along lines 4—4 of FIG. 1.

As illustrated in FIGS. 3 and 4, the holder strip 12 is bent along the edge 17 to provide a spacer portion 21 extending away from the plate 14 and is bent again along a line 22 forming a terminal portion 23 that projects parallel to the plate 14 and toward the end 19 thereof. The terminal portion 23 and the plate 14 form a chamber 24 that is open on three sides so as to facilitate entry of a strap 25 schematically shown by dotted lines in FIG. 4. Preferably, the spacing between the terminal portion 23 and the side 13 of the plate 14 is greater than one-quarter inch so as to accommodate without bending stress the strap thicknesses typically employed with receptacles such as handbags, camera cases, diaper bags, etc.

The securing mechanism 15 is formed by a continuous wire strip 30 having pointed ends 31 on parallel, spaced apart pin portions 32. Orthogonal bends 33 in a mid-section of the wire 30 establish an attachment member length 34 that is secured by welding to the side 16 of the plate 14. The member 34 is attached adjacent the end 16 of the plate such that the pin portions 32 extend toward the end 18 thereof. Additional orthogonal bends 35 in the wire 30 create spacer portions 36 between the attachment member length 34 and the pin portions 32. As shown in FIG. 4, the attachment member 34 is received by a recess 37 in the plate 14. The recess 37 aids in positioning of the securing member 15 during fabrication of the retainer 11 and additionally improves the structural bond between the attachment member 34 and the plate 14.

A person using the retainer 11 secures the pins 32 to clothing covering his shoulder with the side 13 of the plate 14 facing upwardly and the end 19 thereof facing his neck. A shoulder strap attachment to a suitable receptacle is then passed over the terminal portion 23 of the strip 12 and into the chamber 24 where it is retained between the strip 12 and the base plate 14. When positioned in this manner, the weight of the receptacle exerts a force through the strap 25 having a downward vertical component and a horizontal component directed toward the end 18 of the plate 14. Both these components tend to force the pin sections 32 into the clothing and thereby more securely retain the plate 14 in position.

Obviously, many modifications and variations of the present invention are possible in light of the above teachings. It is to be understood, therefore, that the invention can be practiced otherwise than as specifically described.

What is claimed is:

1. A retainer for holding a strap on a person's shoulder and comprising:

a base plate;

a strip member comprising a spacer portion fixed to one side of said base plate adjacent to one end thereof and extending away from said one side, and a terminal portion spaced from and substantially parallel to said one side and extending toward an opposite end of said base plate so as to form a chamber with three open sides that accommodate entry and exit of the strap, said strip member comprising an original portion of said base plate severed therefrom except for an edge joining said base plate and said spacer portion and having a bend at said edge and a bend joining said spacer and terminal portions; and securing means fixed to a side of said base plate opposite said one side, said securing means comprising solely of a pair of spaced apart substantially parallel pins with free pointed ends for penetrating clothing worn on the person's shoulder, and an attachment member joining ends of said pins and fixed within a recess in said opposite side of said base plate and adjacent said opposite end, said pins comprising spacer portions rigidly fixed to said attachment member and terminal portions joined to said spacer portions by bends and spaced from and substantially parallel to said opposite sides of said base plate and extending toward said one end.

2. A retainer according to claim 1 wherein said terminal portion is spaced at least one-quarter inch from said one side.

3. A retainer according to claim 1 wherein said original portion is centrally located in said base plate.

* * * * *